United States Patent [19]

Kabasin

[11] Patent Number: 4,711,218

[45] Date of Patent: Dec. 8, 1987

[54] ACCELERATION ENRICHMENT FUEL CONTROL

[75] Inventor: Daniel F. Kabasin, Rochester, N.Y.

[73] Assignee: General Motors Corporation, Detroit, Mich.

[21] Appl. No.: 11,292

[22] Filed: Feb. 5, 1987

[51] Int. Cl.[4] ..... F02D 41/10

[52] U.S. Cl. ..... 123/492; 123/488; 364/431.07

[58] Field of Search ..... 123/492, 493, 488; 364/431.07

[56] References Cited

U.S. PATENT DOCUMENTS 4,359,993 11/1982 Carlson ..... 123/492
4,499,881 2/1985 Takao ..... 123/492

FOREIGN PATENT DOCUMENTS 60-35158 2/1985 Japan ..... 123/492

*Primary Examiner*—Andrew M. Dolinar
*Attorney, Agent, or Firm*—Howard N. Conkey

[57] ABSTRACT

Acceleration enrichment for an internal combustion engine is provided in response to the rate of change of an unfiltered measurement of throttle position at the lower engine speeds and in response to the rate of change of a filtered measurement of throttle position at the higher engine speeds.

3 Claims, 4 Drawing Figures

ACCELERATION ENRICHMENT FUEL CONTROL

BACKGROUND OF THE INVENTION

This invention is directed toward a system for supplying fuel to an engine and, more particularly, to a fuel supply system in which acceleration enrichment is provided in response to a sensed engine transient condition representing an increasing power demand of the engine.

During accelerating conditions of an internal combustion engine, lean air/fuel ratio excursions in the air and fuel mixture drawn into the cylinders will typically result if the fuel supply rate to the engine is not increased beyond the normal steady state running fuel requirements. In order to prevent the lean excursions in the air/fuel ratio of the mixture drawn into the engine during an acceleration maneuver of the engine, numerous forms of acceleration enrichment systems have been proposed that increase the fuel supplied to the engine during the transient engine condition.

One known acceleration enrichment system provides enrichment in response to transient engine operating conditions as represented by changes in the throttle position controlling the air input of the engine. Typically, the amount of fuel increase is dependent upon factors including coolant temperature and engine speed.

In this form of acceleration enrichment system, at low engine speeds it is desirable to respond rapidly to a sensed transient condition represented by a change in the throttle position in order to provide satisfactory engine operation. However at higher engine speeds, acceleration enrichment provided by a rapid response to a change in the throttle position results in excessive fuel being supplied to the engine. At the higher engine speeds, it is desirable to respond more slowly to a sensed transient condition represented by a change in the throttle position. However, at the lower engine speeds, a slow response to changes in the throttle position results in excessive acceleration enrichment fuel being provided to the engine too late.

SUMMARY OF THE INVENTION

In accord with this invention, the acceleration enrichment fuel is provided to an engine in response to throttle position so that the acceleration fuel requirements are more accurately provided over the full operating speed range of the engine. Particularly, when the engine is operating at the lower engine speeds, acceleration enrichment fuel is provided in response to an unfiltered measurement of throttle position. This provides for the desired rapid response in providing the acceleration enrichment fuel requirement of the engine at the lower engine speeds.

Further in accord with this invention, when the engine is operating at the higher engine speeds, the acceleration enrichment fuel requirements are provided to the engine in response to a filtered measurement of the throttle position. This response to a filtered measurement of throttle position provides the desired engine performance without excessive fuel being delivered to the engine at the higher engine operating speeds.

By selecting between the filtered and unfiltered measurement of throttle position based on engine speed, the acceleration enrichment requirements of the engine are more accurately provided over the full engine operating range.

DESCRIPTION OF THE DRAWINGS

The invention may be best understood by reference to the following description of a preferred embodiment and the drawings in which.

DESCRIPTION OF THE INVENTION

Figure 1:
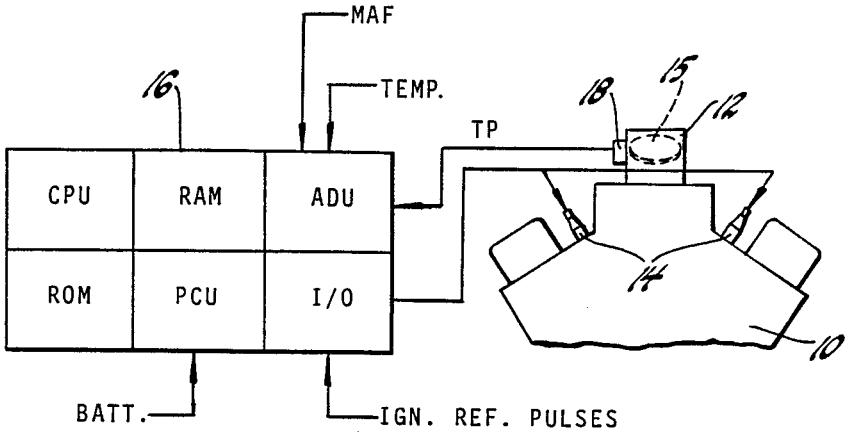
FIG. 1 is a general diagram of an engine fuel control system incorporating the fuel enrichment principles of this invention.

Referring to FIG. 1, there is illustrated a vehicle internal combustion engine 10. Air is drawn into the engine intake manifold through a throttle bore 12 and mixed with fuel injected into the intake manifold by electromagnetic fuel injectors 14. The air/fuel mixture in turn is drawn into the cylinders of the engine 10 where it undergoes combustion. While two fuel injectors 14 are illustrated, it is understood that in the present embodiment, a port fuel injection system is utilized wherein an injector is provided for each cylinder of the engine 10.

The air input to the engine 10 is regulated by means of a conventional throttle 15 in the throttle bore 12. Fuel into the engine 10 is controlled by operation of the fuel injectors 14 via an engine controller 16 in response to measured values of engine operating parameters including mass air flow MAF into the engine 10 provided by a conventional mass air flow sensor, engine temperature TEMP provided by a conventional temperature sensor and a throttle position signal TPS provided by a throttle position sensor 18 measuring the position of the throttle 15 in the throttle bore 12 so as to establish a predetermined scheduled air/fuel ratio and to provide for acceleration enrichment in accord with the principles of this invention.

The engine controller 16 takes the form of a digital computer that is standard in form and includes a central processing unit (CPU) which executes an operating program permanently stored in a read only memory (ROM) which also stores tables and constants utilized in controlling the fuel injected by the injectors 14. Contained within the CPU are conventional counters, registers, accumulators, flag flip flops, etc., along with a clock which provides a high frequency clock signal.

The computer also includes a random access memory (RAM) into which data may be temporarily stored and from which data may be read at various address locations determined in accord with the program stored in the ROM. A power control unit (PCU) receives battery voltage and provides regulated power to the various operating circuits.

The computer further includes an input/output circuit (I/O) comprised of an output section that provides timed injection pulses to the fuel injectors 14 and an input section that receives ignition reference pulses from a conventional vehicle ignition circuit in the form of a reference pulse with each engine cylinder intake event. These pulses are utilized by the engine controller 16 for initiating normal injection pulses to the injectors 14 and for measuring engine speed.

An analog-to-digital unit (ADU) provides for measurement of the analog signals including the signals representing the mass air flow MAF into the engine 10 and the engine temperature TEMP and also a signal provided by a throttle position sensor 18 representing the rotational position TP of the throttle 15. These signals are sampled and converted under control of the CPU and stored in ROM designated RAM memory locations.

The engine controller 16 provides for the normal running fuel requirements of the engine 10 to achieve a desired air/fuel ratio of the mixture drawn into the cylinders by providing timed injection pulses to the injectors 14 in synchronism with engine rotation. The manner in which these injection pulses are determined by the engine controller is conventional and therefore will not be described in further detail.

Figure 2:
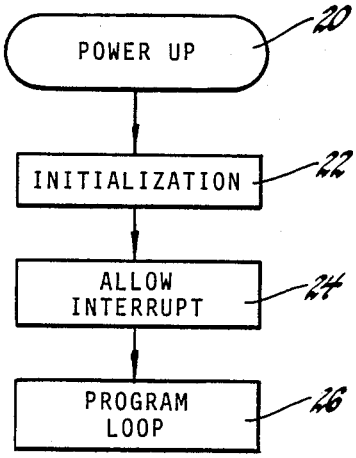
FIGS. 2 through 4 are diagrams illustrating the operation of the system of FIG. 1.
Figure 4:
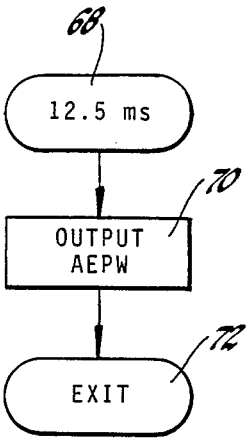
Figure 3:
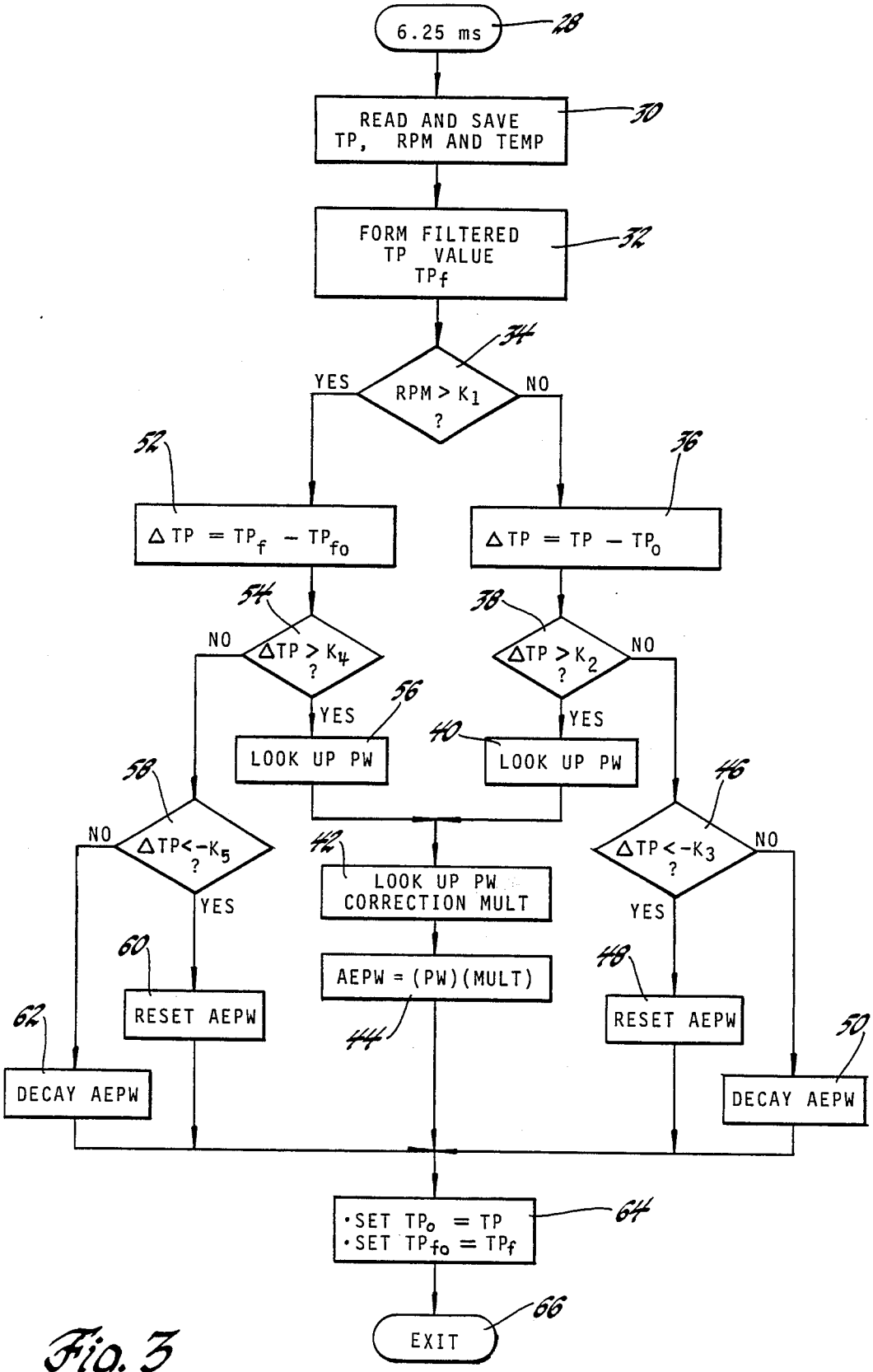

The operation of the engine controller 16 in controlling the fuel injectors 14 to establish acceleration fuel enrichment in accord with the principles of this invention is illustrated in FIGS. 2 thru 4. First referring to FIG. 2, when power is first applied to the system such as when the vehicle ignition switch is rotated to its run position, the computer program is initiated at point 20 and then proceeds to a step 22 where the program provides for system initialization. For example, at this step initial values stored in the ROM are entered into ROM designated RAM memory locations and the various counters, flags, and timers are initialized.

After the initialization step 22, the program proceeds to a step 24 where it allows interrupts to occur and then to a program loop 26 which is continuously repeated. This loop includes all of the measurement, control and diagnostic routines for the engine 10 including the routine for providing acceleration enrichment in accord with this invention.

Various timed intervals are established by the engine controller 16 via internal counters for execution of the various routines in the program loop 26. In general, these intervals are established by counting the output of the high frequency clock in the CPU. In the present embodiment, one interrupt is provided by the CPU at 6.25 millisecond intervals during which the routine for determining the acceleration enrichment fuel delivery is executed. Additionally, an interrupt is provided by the CPU at 12.5 millisecond intervals during which the engine controller 16 provides an acceleration enrichment output pulse AEPW to the fuel injectors 14 having a duration determined by the acceleration enrichment routine of FIG. 3.

Various conventional program routines are repeatedly executed by the control unit 16 at their respective timed intervals. These routines include routines for controlling spark ignition, for controlling engine idle speed and for establishing the normal fuel delivery. Since these program routines are conventional, their details are not further described.

The routine executed at 6.25 millisecond intervals for establishing the acceleration enrichment fuel to be supplied to the engine 10 is illustrated in FIG. 3. In general, this routine determines when the condition exists requiring acceleration enrichment and the width of the acceleration enrichment pulse to be issued to the fuel injectors 14 at each $12\frac{1}{2}$ millisecond interval via the routine of FIG. 4.

When the engine speed is equal to or below a predetermined value $K_1$, the routine provides for acceleration enrichment if the change in the unfiltered value of the throttle position over the past 6.25 millisecond interval exceeds a predetermined value $K_2$. When the engine speed is greater than the predetermined value $K_1$, the routine provides for acceleration enrichment if the change in a filtered value of the throttle position over the past 6.25 millisecond interval exceeds the predetermined value $K_2$.

Once acceleration enrichment is initiated, the routine decays the amount of acceleration enrichment over time or terminates acceleration enrichment if the throttle position decreases over the past 6.25 millisecond interval by an amount greater than a predetermined value $K_3$. This condition indicates that the vehicle operator has terminated the acceleration maneuver.

Referring to FIG. 3, the 6.25 millisecond routine is entered at point 28 and proceeds to a step 30 where the engine controller 16 commands the ADU to convert the analog values of the signals representing the engine temperature TEMP and the unfiltered throttle position TP to digital values. The converted values are then stored in the RAM as the new values of engine temperature TEMP and throttle position TP. Also at step 30, the engine speed RPM represented by the frequency of the ignition reference pulses is obtained via the I/O and stored in the RAM. In this respect, the I/O may include an input counter that counts the number of clock pulses between ignition reference pulses to determine engine speed.

From step 30, the program proceeds to a step 32 where the program forms a filtered throttle position value that represents a filtered measurement of throttle position. This filtered measurement of throttle position is provided in this embodiment by means of a first order lag filter equation that takes the form $$TP_f = TP_{fo} - (TP_{fo} - TP)/K$$

where $TP_f$ represents the value of the filtered measurement of throttle position, $TP_{fo}$ represents the prior value of the filtered measurement of throttle position determined during the prior execution of the 6.25 millisecond interrupt routine of FIG. 3, TP is the value of the unfiltered measurement of throttle position read and saved at step 30 and K is a constant establishing the time constant of the equation.

From step 32, the program proceeds to a step 34 at which the engine speed value RPM measured and stored at step 30 is compared to a calibration constant $K_1$ representing a threshold engine speed below which acceleration enrichment is to be determined based on the unfiltered measurement of throttle position TP and above which the acceleration enrichment is to be based upon the filtered measurement of throttle position $TP_f$ determined at step 32.

Assuming the engine speed is below the threshold $K_1$ where acceleration enrichment is to be determined based on the unfiltered measurement of throttle position, the program proceeds to a step 36 where the change in the throttle position over the last 6.25 millisecond period is determined based on the expression $$\Delta TP = TP - TP_o$$

where $\Delta TP$ is the change in the throttle position, TP is the unfiltered measurement of throttle position saved at step 30 and $TP_o$ is the unfiltered measurement of throttle position determined during the previous execution of the 6.25 millisecond $\Delta$ interrupt routine. The value determined at step 36 in conjunction with the interval of the interrupt routine establishes a rate of change in the unfiltered measurement of throttle position.

From step 36, the program proceeds to a step 38 where $\Delta TP$ is compared with a calibration constant $K_2$ representing a rate in change of throttle position above which acceleration enrichment is to be initiated. If at any time while the engine speed is less than the threshold value $K_1$, the change in the unfiltered throttle position exceeds the value $K_2$ as determined at step 38, the program proceeds to a step 40 where a base acceleration enrichment pulse width value PW is obtained from a lookup table stored in the ROM. This value is dependent upon the magnitude of the rate of change in the throttle position as determined at step 36.

From step 40, the program proceeds to a step 42 where a temperature correction multiplier MULT is obtained from a lookup table stored in the ROM representing a correction to the base pulse width value PW as a function of engine temperature. Thereafter at step 44, the acceleration enrichment fuel pulse width AEPW to be issued to the engine at each 12.5 millisecond interval is determined by multiplying the base pulse width PW obtained at step 40 by the correction multiplier value MULT obtained at step 42. The steps 40 through 44 are repeated with each execution of the 6.25 millisecond interrupt routine as long as step 38 represents a rate of change of throttle position greater than the rate represented by the value $K_2$.

Returning to step 38 and assuming the rate of change in throttle position is below the value represented by the constant $K_2$, the program proceeds to a series of steps 46 through 50 where any previous acceleration enrichment fuel pulse width value AEPW is either decayed toward zero or terminated if the position of the throttle 15 has decreased by an amount $K_3$.

At step 46, the change in throttle position determined at step 36 is compared with a change represented by a constant $-K_3$. If the rate of change in throttle position is less than this negative value, it represents a condition wherein the throttle position is decreasing and acceleration enrichment is to be terminated. Assuming this condition exists, the program proceeds to a step 48 where the acceleration enrichment fuel pulse width AEPW is reset to zero.

If step 46 determines that the throttle position is not decreasing at a rate represented by the constant $-K_3$, the program proceeds to a step 50 where the acceleration enrichment fuel pulse width AEPW is decayed toward zero. This decay can be in accord with a first order lag filter equation similar to the equation described with respect to step 32. The step 46 and step 48 or 50 are continually repeated until the value of the acceleration enrichment fuel pulse width AEPW is reset by step 48 or decayed to zero by step 50 after which the value of AEPW remains at zero until the conditions for acceleration enrichment are again detected.

Assuming the engine speed is greater than the threshold $K_1$ where acceleration enrichment is to be determined based on the filtered measurement of throttle position, the program proceeds to a step 52 where the change in the throttle position over the last 6.25 millisecond period is determined based on the expression $$\Delta TP = TP_f - TP_{fo}$$

where ΔTP is the change in the throttle position, $TP_f$ is the filtered measurement of throttle position determined at step 32 and $TP_{fo}$ is the filtered measurement of throttle position determined during the previous execution of the 6.25 millisecond Δ interrupt routine. The value determined at step 52 in conjunction with the interval of the interrupt routine establishes a rate of change in the filtered measurement of throttle position.

From step 52, the program proceeds to a step 54 where ΔTP is compared with the calibration constant $K_4$ representing a rate in change of throttle position above which acceleration enrichment is to be initiated. In one embodiment, $K_4$ may be equal to $K_2$ used at step 38. If at any time while the engine speed is greater than the threshold value $K_1$, the change in the filtered throttle position exceeds the value $K_4$ as determined at step 54, the program proceeds to a step 56 where the base acceleration enrichment pulse width value PW is obtained from a lookup table stored in the ROM. As previously described, this value is dependent upon the magnitude of the rate of change in the filtered throttle position as determined at step 52.

From step 56, the program proceeds to the steps 42 and 44 where the acceleration enrichment fuel pulse width AEPW is determined as previously described. The steps 56, 42 and 44 are repeated with each execution of the 6.25 millisecond interrupt routine as long as step 54 detects a rate of change of throttle position greater than the rate represented by the value $K_4$.

Returning to step 54 and assuming the rate of change in the filtered throttle position is below the value represented by the constant $K_4$, the program proceeds to a series of steps 58 through 62 where any previous acceleration enrichment fuel pulse width value AEPW is either decayed toward zero or terminated if the filtered position of the throttle 15 has decreased by an amount greater than $K_5$. In one embodiment, $K_5$ may be equal to $K_3$.

At step 58, the change in the filtered throttle position determined at step 52 is compared with a change represented by the constant $-K_5$. If the rate of change in the filtered throttle position is less than this negative value, it represents a condition wherein acceleration enrichment is to be terminated. Assuming this condition exists, the program proceeds to a step 60 where the acceleration enrichment fuel pulse width AEPW is reset to zero.

If step 58 determines that the filtered throttle position is not decreasing at a rate represented by the constant $-K_5$, the program proceeds to a step 62 where the acceleration enrichment fuel pulse width AEPW is decayed toward zero in a manner similar to step 50. The step 58 and step 60 or 62 are continually repeated until the value of the acceleration enrichment fuel pulse width AEPW is reset by step 60 or decayed to zero by step 62 after which the value of AEPW remains at zero until the conditions for acceleration enrichment are again detected.

From step 44, 48, 50, 60 or 62, the program proceeds to a step 64 where the old value of the throttle position $TP_o$ (to be utilized when step 36 is next executed to determine the change in the throttle position ΔTP) is reset to the value read and stored at step 30. Similarly, the old value $TP_{fo}$ the filtered throttle position signal to be utilized when step 52 is next executed to determine the change in the throttle position ΔTP is reset to the value last determined at step 32. From step 64, the program exits the 6.25 millisecond interrupt routine at step 66.

In summary, the foregoing routine of FIG. 3 provides for an acceleration enrichment pulse width when the engine speed is above the value $K_1$ based on the rate of change in the filtered throttle position and when the engine speed is below the value $K_1$ provides acceleration enrichment based on the rate of change in the unfiltered throttle position. In this manner, the acceleration enrichment requirements of the engine are provided over the full range of engine operating conditions.

Referring to FIG. 4, the 12.5 millisecond interrupt routine is described. This routine is entered at step 68 and proceeds to a step 70 where the acceleration enrichment pulse width having a duration AEPW established by the routine of FIG. 3 is outputted to the fuel injectors 14 via the I/O of the engine controller 16. Thereafter, the program exits the 12.5 millisecond interrupt routine at step 72. Via the routine of FIG. 4, the acceleration enrichment pulse width is repeatedly provided at 12.5 millisecond intervals as established by the routine of FIG. 3.

The foregoing description of a preferred embodiment of the invention for purposes of illustrating the invention is not to be considered as limiting or restricting the invention since many modifications may be made by the exercise of skill in the art without departing from the scope of the invention.

The embodiments of the invention in which an exclusive property or privilege is claimed are defined as follows:

1. A fuel supply system for an internal combustion engine having a throttle for controlling its air input, the engine being characterized in that its steady state operating fuel requirements vary from its transient operating fuel requirements, the fuel supply system comprising:

means for measuring engine speed;

means for measuring throttle position;

means for filtering the measured throttle position;

means for sensing an engine transient operating condition representing an engine acceleration enrichment fuel requirement in response to (A) the rate of change in the measured throttle position when the engine speed is less than a predetermined threshold and (B) the rate of change in the filtered throttle position when the engine speed is greater than the predetermined threshold; and means for supplying acceleration enrichment fuel to the engine when an engine transient operating condition is sensed, whereby the transient operating fuel requirements of the engine are provided in response to changes in the throttle position over the full operating speed range of the engine.

2. The method of supplying the acceleration transient fuel requirements of an internal combustion engine having a throttle for controlling its air input, the engine being characterized in that its steady state operating fuel requirements vary from its transient operating fuel requirements, the method comprising the steps of:

measuring engine speed;

measuring throttle position;

filtering the measured throttle position;

sensing an engine transient operating condition representing an engine acceleration enrichment fuel requirement in response to (A) the rate of change in the measured throttle position when the engine speed is less than a predetermined threshold and (B) the rate of change in the filtered throttle position when the engine speed is greater than the predetermined threshold; and supplying acceleration enrichment fuel to the engine when an engine transient operating condition is sensed, whereby the transient operating fuel requirements of the engine are provided in response to changes in the throttle position over the full operating speed range of the engine.

3. A system for detecting a transient operating condition of an internal combustion engine to initiate acceleration fuel enrichment, the engine having a throttle for controlling its air input, the system comprising, in combination:

means for measuring engine speed;.

means for measuring throttle position;

means for filtering the measured throttle position;

means for indicating a transient operating condition while the engine speed is less than a predetermined speed when the rate of change in the measured throttle position exceeds a first predetermined rate; and means for indicating a transient operating condition while the engine speed is greater than the predetermined speed when the rate of change in the filtered measured throttle position exceeds a second predetermined rate.

* * * * *